US010569432B2

(12) United States Patent
Halucha

(10) Patent No.: US 10,569,432 B2
(45) Date of Patent: Feb. 25, 2020

(54) AUTOMATICALLY OPENING TOOL WITH SLIDING SCALE RELEASE

(71) Applicant: Walter Halucha, Montauk, NY (US)

(72) Inventor: Walter Halucha, Montauk, NY (US)

( * ) Notice: Subject to any disclaimer, the term of this patent is extended or adjusted under 35 U.S.C. 154(b) by 88 days.

(21) Appl. No.: 15/792,204

(22) Filed: Oct. 24, 2017

(65) Prior Publication Data

US 2018/0169874 A1 Jun. 21, 2018

Related U.S. Application Data

(60) Provisional application No. 62/436,570, filed on Dec. 20, 2016.

(51) Int. Cl.
*B26B 1/04* (2006.01)

(52) U.S. Cl.
CPC ..... *B26B 1/042* (2013.01)

(58) Field of Classification Search
CPC ..... B26B 1/042; B26B 1/04; B26B 1/048
USPC ..... 30/155, 151, 153, 161, 289; 7/118–120
See application file for complete search history.

(56) References Cited

U.S. PATENT DOCUMENTS 3,079,686 A * 3/1963 Christy ..... B26B 1/08 30/162
4,389,776 A * 6/1983 Okada ..... B26B 5/005 30/162
5,111,581 A 5/1992 Collins
5,325,588 A * 7/1994 Rogers ..... B25G 1/06 30/155
5,425,175 A * 6/1995 Rogers ..... B25G 1/06 30/155
5,878,500 A 3/1999 Emerson
5,915,792 A * 6/1999 Sakurai ..... B26B 1/048 30/155
5,964,035 A * 10/1999 Poehlmann ..... B26B 1/046 30/155
6,122,829 A 9/2000 McHenry et al.
6,427,335 B1 8/2002 Ralph
6,438,848 B1 8/2002 McHenry et al.
6,826,836 B1 * 12/2004 Lin ..... B26B 1/048 30/155
7,036,174 B2 * 5/2006 Painsith ..... A45D 29/20 206/234
7,107,686 B2 * 9/2006 Linn ..... B26B 1/02 30/159
7,249,417 B2 * 7/2007 Chu ..... B26B 1/04 30/155
7,562,454 B2 7/2009 Steigerwalt et al.
7,748,122 B2 * 7/2010 Duey ..... B26B 1/048 30/159
7,854,067 B2 * 12/2010 Lake ..... B26B 1/044 30/159
8,281,437 B2 * 10/2012 Hunkele ..... B26B 11/001 30/155

(Continued)

*Primary Examiner* — Ghassem Alie
*Assistant Examiner* — Bharat C Patel
(74) *Attorney, Agent, or Firm* — Dilworth & Barrese, LLP

(57) ABSTRACT

An automatically opening tool with a sliding scale release. The assembly includes a modular body; a tool; a gear assembly attached to the tool; a first resilient member for rotating the tool; a sear configured to mate with the gear assembly; a second resilient member for imparting a resilient force to the sear; and cover plates. When the tool is closed, moving the cover plate causes the tool to open automatically.

19 Claims, 5 Drawing Sheets

(56) References Cited

U.S. PATENT DOCUMENTS

| | | | | |
|---|---|---|---|---|
| 8,375,590 | B2 * | 2/2013 | Duey | B26B 1/048 30/159 |
| 8,499,460 | B1 * | 8/2013 | Pearman | B26B 1/044 30/155 |
| 8,549,754 | B2 * | 10/2013 | Bung | B26B 1/04 30/155 |
| 9,227,330 | B2 * | 1/2016 | Fellows | B26B 1/048 |
| 9,346,176 | B2 * | 5/2016 | Collins | B26B 1/044 |
| 9,505,141 | B2 * | 11/2016 | Duey | B26B 1/046 |
| 9,527,218 | B2 * | 12/2016 | Valdez | B26B 1/02 |
| 9,579,807 | B2 * | 2/2017 | Chu | B26B 1/04 |
| 9,764,485 | B1 * | 9/2017 | Hawk | B26B 1/08 |
| 2011/0099817 | A1 | 5/2011 | Duey | |
| 2014/0115898 | A1 | 5/2014 | Collins | |

* cited by examiner 8
10
23
7
14
15
11
1
2
200
9
90
6
15
3
1
200

AUTOMATICALLY OPENING TOOL WITH SLIDING SCALE RELEASE

CROSS REFERENCE TO RELATED APPLICATIONS

This application claims priority to provisional application Ser. No. 62/436,570, filed Dec. 20, 2016, the entire contents of which are incorporated herein by reference.

BACKGROUND

The invention relates generally to spring-activated tools, such as knives, which can be opened automatically with the activation of a release.

Automatic knives and other tools with spring loaded blades have a variety of configurations and release button designs. For example, some knives have a reciprocating (sliding) button and are referred to as having Flylock mechanisms. Existing Flylock sliding buttons generally move along the long longitudinal axis of the knife, within a cavity in the front, distal portion of the handle. As used herein, for purposes of reference only, an open knife will be referred to as oriented with its tip at its distal end and its blade edge facing upwards, to define a front left side of the handle and a rear right side of the handle. When closed, the tip will face the proximal direction with the blade edge facing downwards with a front left handle side and a right rear handle side.

The side handle portion of a flylock design knife may only be a cover plate ("scale"), and not part of the frame or mechanism. Flylock mechanisms typically have a complex multiplicity of parts, including pins, springs, levers, cams and screws that are factory assembled into a permanent unit. Typically, they are not internally user serviceable, and are not readily reconfigurable for both left-hand and right-hand activation. FIG. 5*a* shows a Flylock with the scale installed. FIG. 5*b* shows a Flylock with the scale removed. A sliding button lifts a square tip sear out of a square cut recess cavity in the blade (not shown), and a resilient member (not shown) causes the knife to automatically swing from a closed to an open position. It is closed manually.

Other knives have what is commonly referred to as a scale release, where a scale moves. FIG. 5*c* illustrates a conventional knife activated by the pivoting or rocking motion of an external handle scale on a knife. FIG. 5*d* depicts the knife of FIG. 5*c*, with the scale removed, showing an internal spring plate and sear bellcrank/toggle. The parts of these conventional knives require multiple fasteners and are commonly factory finished. This makes them inconvenient for users to service or reconfigure. Many conventional scale release knives have square cut sears and sear holes. These interacting parts, by nature of a factory manufacturing method, require tolerance clearance to fit together. The resulting tolerance fit leave micro-gaps in the machinery that have a cumulative effect resulting in potential blade wiggle in either open or closed positions. This is observable in surviving Flylock knives manufactured in the early 1900's, and also in modern scale release knives, as part surfaces wear with age, increasing the loose play in an "locked" blade.

These and other shortcomings in the prior art are solved by the present invention.

SUMMARY OF THE INVENTION

An automatically opening tool with a sliding scale release according to the present disclosure can be configured for both right-hand and left-hand use. It has fewer parts and is easily serviced or reconfigured by a user. Tools in accordance with the invention can have a sliding scale that can be moved to release the tool, such as a knife. The automatically opening tool includes a U-shaped or C-shaped frame with two opposing side walls and a gap therebetween to receive the tool. Each wall can be the mirror image of the other, for reconfiguration for use by the opposite hand.

One and preferably both of the walls have an opening, such as a keyhole shaped opening having a round portion near the distal end of the wall and a slot proximal to the round portion. The opening is shaped to receive a circular cam that can be joined to a resilient member, such as a coil kick spring that biases the cam to rotate. The cam can be joined to the tool, to automatically swing the tool open when the cam is released. If present, the slot of the keyhole can have a shelf at its proximal end.

A sear can be provided to releasably lock the cam in place, with the tool in the open or closed position. The sear should be biased in camming engagement with the cam, preferably in the distal direction. The sear can have a head for engaging the cam and a shaft extending proximally from the head. The proximal end of the sear shaft can be placed on the shelf. The head portion at the distal end is preferably wedge shaped and nests into one of a pair of V-shaped grooves in the cam. The grooves are preferably on opposite sides of the cam, one to lock the cam and thereby the tool open and one to lock it closed.

One side of the tool handle includes a sliding cover (scale) coupled to the sear. The cam is biased to bias the tool into the open position. If the tool is locked in the closed position, sliding the scale proximally can unlock the cam and permit the resilient member to rotate the cam, which in turn, kicks open the tool. Releasing the handle can permit the sear to advance into the cam and eventually the groove in the cam and lock the tool in an open position. To close the tool, the handle is again slid proximally to release the cam from the sear, and the tool can be closed by hand. The scale/cover is released and the sear is resiliently urged in the distal direction and engages a groove on the cam to lock the tool back in the closed position.

The sear can have a chisel or wedge shape tip head at its distal end. The circular cam can include V-shaped notches that match a V-shaped sear head. The head can act a cam follower and wedge into the V-notches in the open and the closed positions. This wedging action produces an open blade that locks more stiffly in place, with less movement or play than many other configurations.

In one embodiment of the invention, the tool can be fit together similarly to a mechanical puzzle and requires only two fasteners, such as screws or pins—one to connect a latch, such as a scale to the sear and one to connect the cam to the tool. All the other parts can be configured and arranged to fit together into place.

The major components of a tool in accordance with the invention comprises the blade assembly (a blade or other tool, which is coupled to a cam, which is coupled to a resilient member such as a coil kick spring; a handle assembly (a frame and two sliding covers); and the button assembly (the sear coupled to a cover and resiliently biased into and interacting with the cam) These elements are puzzle fit and hold themselves in place. The screws or pins fasten together the moving sub-assemblies. The screws or pins are internal and need not be seen when the tool is assembled. This provides a clean outward appearance, without visible pins or screws.

The scale release front (left side) scale button is preferably flush and can match the rear (right side) scale cover plate, which only functions to cover the internal mechanism and performs no mechanical function other than sealing. Thus, when the tool is a knife, it can appear to be a trick knife with a hidden release or possibly child-proof function.

Tools in accordance with the invention can be made to be user serviceable, and require no special tools to disassemble and reconfigure between left or right hand operation. Thus, this automatic tool design, referred to as a scale release/hidden button design, can include parts, assemblies, features and qualities that are such that constitute, e.g., a knife with a folding blade that is spring operated that locks open and locks closed.

The handle body frame can be a one-piece item with a "C" or "U" shaped channel cross section, having two opposing walls and creating a blade well cavity for receiving the blade (or other feature) in a closed position. The handle body can include dovetail groove tracks cut along the long axis of one or both sides of the exterior of the handle body and the scale can ride in those tracks. The handle body can include a thru hole to act as a blade pivot bushing inside diameter, through one or both of the frame walls and cavities made to conceal internal components, such as the sear and allow access for internal assembly.

The handle features and following internal parts combine to produce an external appearance of a unique operating mechanism that is sleek and without visible fasteners. The blade locking device can include a chisel point (wedge shaped) sear that by nature of its physical shape as a wedge, can force the blade to come to battery or precisely stop in position with less wiggle or play. The chisel point sear can interact with a matching V-notch cam surface on a shaft, such as a step-shaft part in a fashion that normal metal fatigue or abrasive wear is not detrimental to the location fit of said parts. Subsequent use will not adversely affect blade alignment, but rather, can cause the contact surface to sharpen and improve the wedge fit.

The V-notch cam surface profile can be on a multifunctional step shaft, which when fastened to the tool blade, can index the blade to both open and closed positions, locate and retain the blade within the handle so that it will not fall out, act as a pivot shaft bushing and bearing for the blade rotation, and act as a fastening point for the resilient member, such as a coil kick spring.

A knife in accordance with the invention can include insert cover plates referred to as a scale that can slide and move inside a dovetail groove track, cut along the long axis of both outer sides of the handle body. The insert plate scale multifunctions as both a cover plate and a release mechanism. The scale release front scale button can be flush and match the nonfunctional rear scale cover plate in such a way that it appears to be trick knife with a hidden release or possibly child-proof function.

A chisel point sear can be attached to the underside (inner surface) of one of the scales to constitute the operating mechanism sub-assembly or button release of the automatic blade. The sear can be attached to the scale with a fastener inserted thru openings in the handle body in a manner that the fasteners and sear resilient member, such as a compression spring are hidden from view upon final assembly.

A multifunction step shaft and coil kick spring in accordance with the invention can be manufactured with a thin profile, so as to be easily concealed under the exterior scale cover plates. Using multifunction parts can reduce the total number of parts, which can include 1 blade, 1 sear, 1 sear shaft, 2 handle covers, 1 frame, 2 springs, and 2 screws. The parts can be easily disassembled and reassembled by the user, as opposed to a factory permanent pinned assembly.

The internal parts, handle and blade in accordance with the invention can all be made to be ambidextrous, such that either the front (left) or rear (right) scale activates the release, so that reassembly can be for either right handed or left handed users.

The internal parts can be configured such that the same parts can be used in any blade (or other tool) size and or external profile appearance and provide an easy interchangeability of parts.

The internal chisel point sear and the step shaft device can work with a coil kick spring and also with conventional leaf kick springs inside the blade as well.

The external sliding scale can be surface cut into a trademark design appearance shape or pattern profile without adversely affecting the internal components, in such a way that the trademark shape applied to the folding tool can also be applied to an Out-the-Front (OTF) knife or telescoping blade knife, so as to produce a matching set.

The external sliding scale is interchangeable on existing stockpiles of knives, and can be produced with a variety of grip patterns, semi-precious material inserts, or can be engraved or printed as a billboard with any company Logo.

Other objects, advantages and embodiments of the invention will be apparent from the specification and the drawings and the scope of the invention will be indicated in the claims.

BRIEF DESCRIPTION OF THE DRAWINGS

The present disclosure will become more readily apparent from the specific description accompanied by the following drawings, in which.

DETAILED DESCRIPTION OF PREFERRED EMBODIMENTS

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure.

Figure 1:
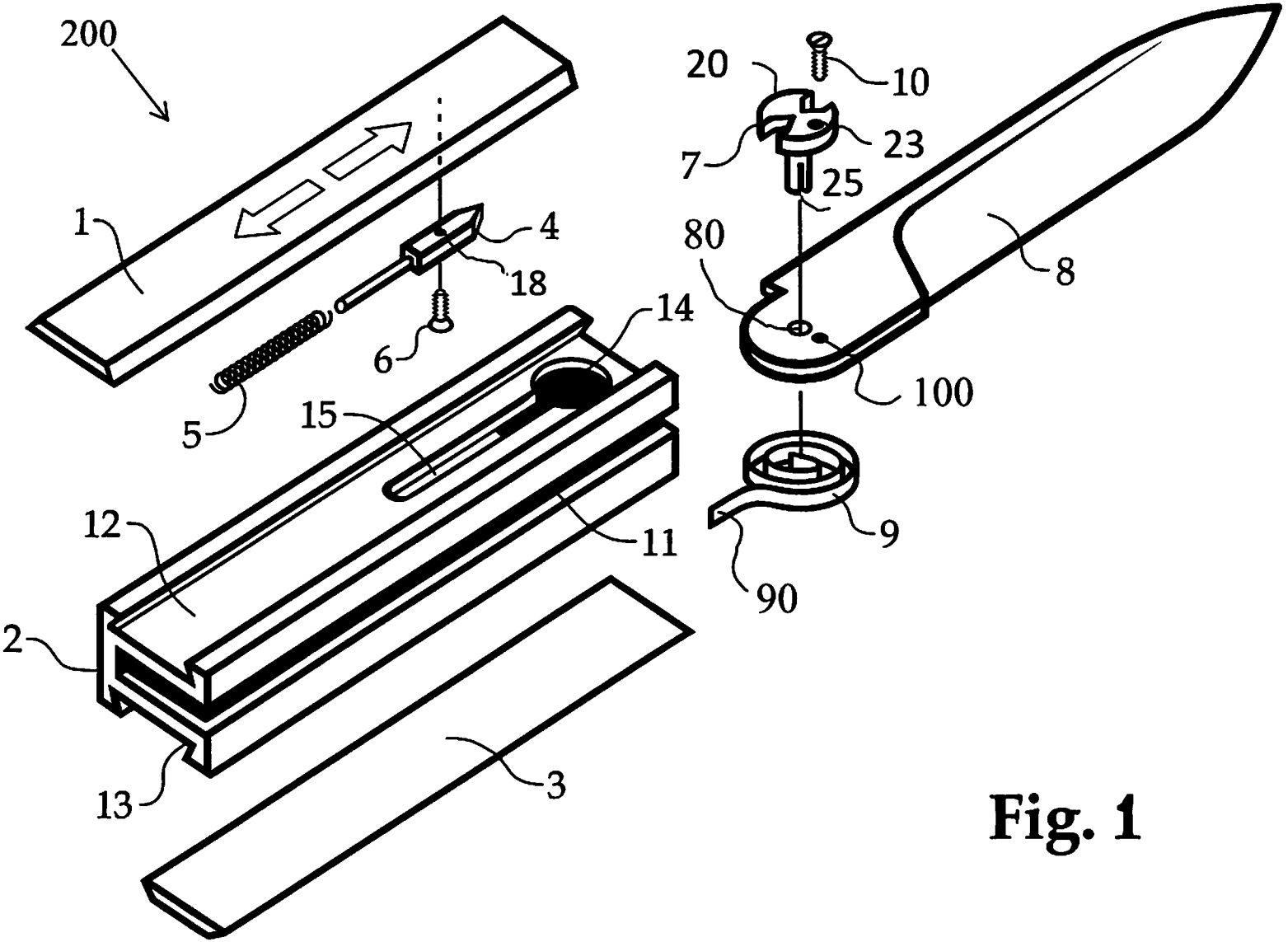
FIG. 1 is an exploded perspective view of an automatically opening tool, in the form of a knife, with sliding scale release, according to an embodiment of the present disclosure.

An exploded perspective view of a tool, in accordance with a preferred embodiment of the present invention, is shown generally in FIG. 1 in the form of a knife 200. Knife 200 includes a handle frame body 2, having a U-shaped or C-shaped cross section and front-side dovetail groove 12 on the front (left-hand) side and a rear-side dovetail groove 13 on the rear (right-hand) side. Knife 200 is assembled for right-handed use, wherein it is activated by moving the front cover. However, frame 2 is symmetrical and can be reassembled as a mirror image for left hand use.

Handle frame 2 can be formed from a metal block, milled so that all features are symmetrical, front and back. Frame 2 can be constructed in other manners, including stamping and welding and other ways as will be apparent to one of skill in the field. Handle frame 2 is formed as two opposing walls, with groove 12 on the outside of the front wall and groove 13 on the outside of the rear wall. A narrow gap is defined between these two walls as blade well cavity 11, which is slightly thicker than the blade. Dove tail grooves 12 and 13 extend along the length axis of frame 2. A front scale 1 (left side looking down on knife 200 with the distal end facing forward and the open blade facing up) rides in groove 12 and a rear scale 3 rides in groove 13. Front scale 1 and rear scale 3 are cut with dovetail edges, to slide into grooves 12 and 13.

Handle frame 2 is also formed with a pivot hole 14, which has the form of a circular thru hole, completely through frame 2. In other embodiments of the invention, the hole can be through only one of the walls or can be in the form of a recess, not a thru hole. Pivot hole 14 is sized to fit the major diameter of a step shaft 7, preferably with a precise fit. Frame 2 also has a keyseat slot 15, extending proximally from pivot hole 14. Keyseat slot 15 has two sections. The distal section, closest to pivot hole 14, is a thru hole extension from pivot hole 14. The proximal section of slot 15 is a true keyseat and has a floor that does not extend all the way through the wall of groove 12. Thus, the proximal end of keyseat slot 15 acts as an internal shelf, and the distal end of slot 15, near pivot hole 14, is a thru hole allowing access to the far side internals for parts assembly. The wall of frame 2 having groove 13 is preferably symmetrical to that of groove 12 and should have a mirror image keyseat slot with a shelf at its proximal end for reconfiguration for left hand use.

Grooves 12 and 13 in frame 2 are identical in size. Front scale 1 is cut to a size allowing a running and sliding fit into dovetail groove 12, so that scale 1 may move with finger or thumb pressure in a reciprocating fashion, as a release button, as discussed below (see arrow indicator markings on scale 1). The dovetail edges of rear scale 3 are cut slightly wider as a location fit or press fit, so that scale 3 can be removably tapped or pressed into place into frame groove 13, as a cover plate. Scale 3 should fit tightly enough, so as not to move with finger pressure during activation of scale 1. Thus, the dovetail edges of scales 1 and 3 should be cut differently, so that when a user's hand causes scale 1 to move proximally, the user's hand will cause scale 3 to move distally, which will wedge scale 3 more firmly in place in groove 13. If reconfigured for left hand use, scale 1 and scale 3 are switched to fit into grooves 13 and 12, respectively, and scale 1 will act as the release and slide in groove 13, with scale 3 motionless in groove 12.

Figure 2:
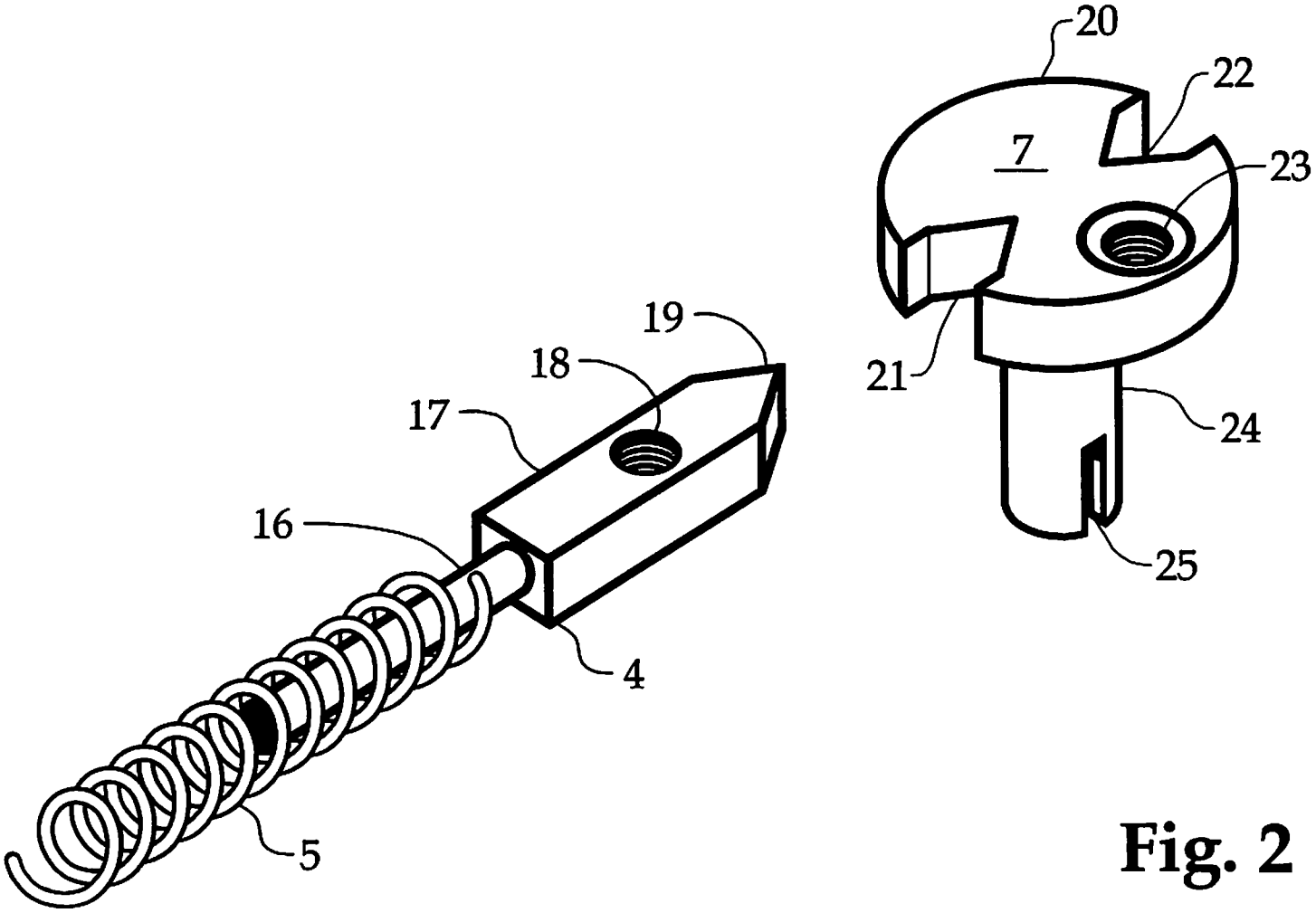
FIG. 2 an exploded perspective view of the sear and cam of the automatically opening tool with sliding scale release of FIG. 1.

FIG. 2 depicts a sear 4, with a sear head having a chisel point 19 at its distal end. Chisel point 19 is preferably formed with two flat sides extending proximally from the point tip. Chisel point 19 is preferably symmetric. The head of sear 4 also includes a flat side 17 having a screw hole 18 formed all the way through sear 4, proximal from point 19. In alternate embodiments of the invention, hole 18 need not be threaded and can have other attachment structures or a smooth bore. A guide post shaft 16 (FIG. 2) extends proximally from the head of sear 4. A sear spring 5, which is a compression spring, fits over guide post shaft 16 and acts as a resilient member to urge sear 4 in the distal direction.

Figures 3A, 3B:
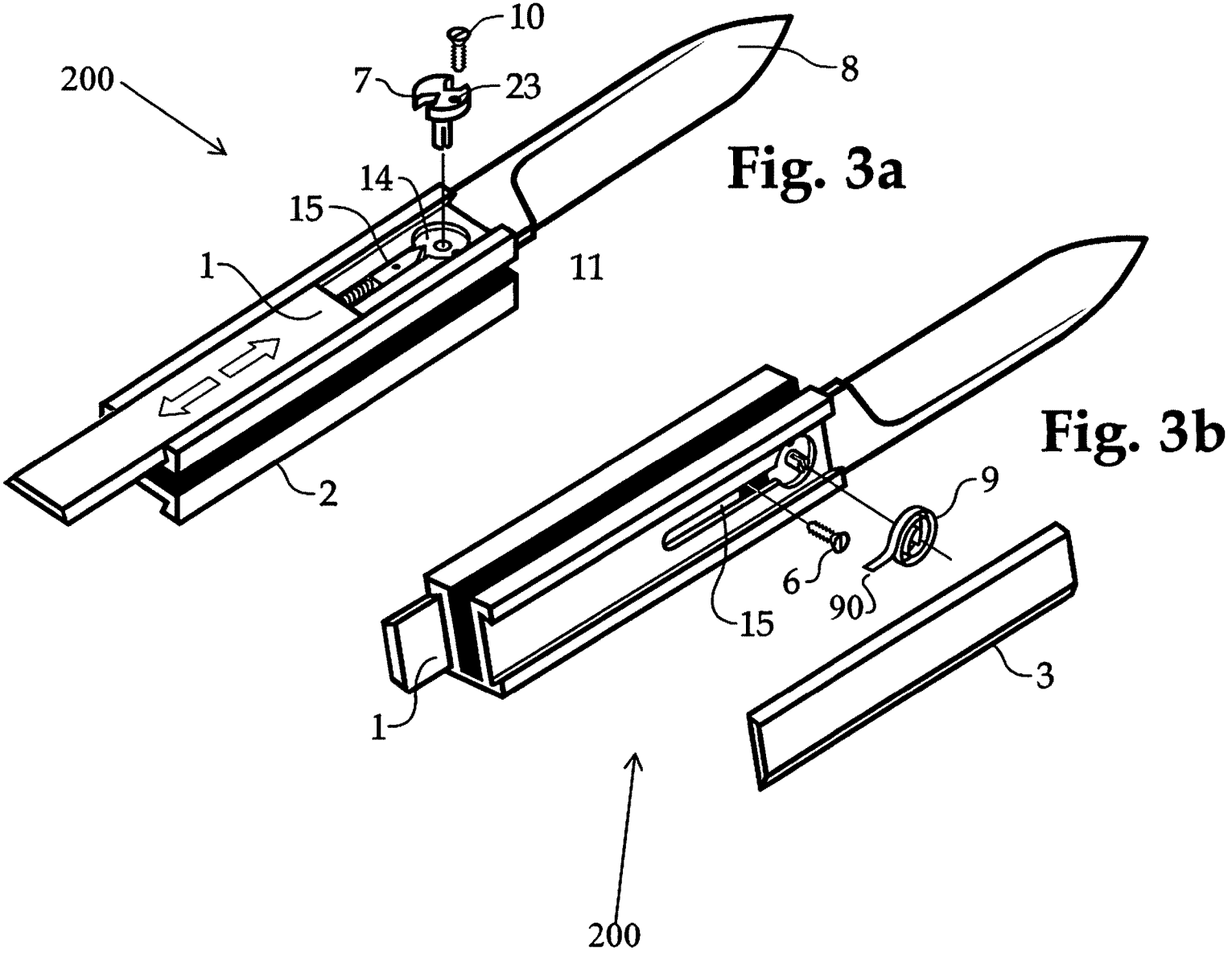
FIGS. 3*a* and 3*b* are partially assembled perspective views of the automatically opening tool with sliding scale release of FIG. 1.

Sear 4 and sear spring 5 are inserted into keyseat slot 15 of groove 12. Shaft 16, with spring 5 thereon rest on the shelf of keyseat slot 15. Point 19 extends in the distal direction, into pivot hole 14. As shown in FIGS. 1 and 3*b*, screw 6 is then inserted into the thru hole portion of slot 15 of groove 13, then the thru hole portion of slot 15 of groove 12, then into a hole in the underside of handle scale 1 (not shown). Thus, scale 1 is connected to sear 4 by screw 6 and they can act as a unit. Compression spring 5 will keep sear 4 and scale 1 biased in the distal position. Hand pressure can compress spring 5 and move scale 1 and therefore also sear 4 in the proximal direction.

Referring again to FIG. 2, sear 4 acts as a cam follower to a step shaft 7. Step shaft 7 has a major diameter 20 and a minor diameter 24. In other embodiments of the invention, it can have a single diameter or multiple diameters. As shown in FIGS. 3*a* and 3*b*, major diameter 20 nests in pivot hole 14 and is held in place by scale 1 on the side of groove 12 and by scale 3 on the side of groove 13. Before inserting step shaft 7, the proximal portion of a blade 8 is placed in the distal end of frame 2, with the edge of blade 8 facing in the same direction as cavity 11. Minor diameter 24 is inserted through a thru hole 80 in the proximal end of blade 8. Blade 8 is then joined to step shaft 7 by inserting a screw 10 through a screw hole 23 (or smooth hole) in step shaft 7 and into a screw hole 100 in the proximal end of blade 8. Blade 8 and shaft 7 now pivot as a unit about pivot hole 14.

An external end 90 of a coiled kick spring 9 is inserted into a saw cut 25 at the bottom of minor diameter 24. External end 90 of kick spring 9 presses against frame 2. In this manner, kick spring 9 is constructed and arranged to impart a rotational bias against step shaft 7, which in turn imparts rotational bias to blade 8.

With blade 8 in the open position, chisel point 19 of sear 4 will nest in a V-notch 21 (FIG. 2) of major diameter 20. To release blade 8, scale 1 is pulled proximally, to detach point 19 from notch 21. The user then folds blade 8, which is connected to shaft 7, closed, against the bias of spring 9. Sear 4 acts as a cam follower until blade 8 is in the closed position and a closed position V-notch 22 faces point 19. Sear 4 (and therefore scale 1) will then move distally and sear 4 will lock into notch 22. To open blade 8, scale 1 is moved proximally, sear 4 disengages from closed notch 22, spring 9 urges shaft 7 to rotate, which causes blade 8 to swing open. Sear 4 follows major diameter 20, until it locks into open position notch 21, to lock blade 8 in the open position. Scale 1, sear 4, spring 5, shaft 7, spring 9 and blade 8 are thereby adapted for blade 8 to swing into in the open position when scale 1 is moved in the proximal direction to disengage sear 4 from shaft 7.

The parts shown are made such that knife 200 can be disassembled and reassembled into a left-hand or right-hand knife by switching scale 1 and scale 3, moving sear 4 and shaft 7 to slot 15 in groove 13 and reversing sear 4 and screw 6.

Note that compression spring 5, on shaft 16 of sear 4, is coupled to front scale 1 by sear retaining screw 6. That combination constitutes a moving sub-assembly of parts within the whole of knife 200. Also, step shaft 7, with kick spring 9 inserted in cut 25 is coupled to blade 8 by screw 10. It therefore constitutes a separate moving sub-assembly of parts within the whole of knife 200.

Step shaft 7 has multiple purposes and functions. Major diameter 20 of step shaft 7 functions as both a main pivot bearing for folding knife blade 8. It also acts as a structural/puzzle retaining piece which will be explained below with reference to FIGS. 3*a* and 3*b*. Major diameter 20 has two V-Notches 21 and 22, which are 180 degrees apart, and are sized to match chisel point 19 of sear 4. Screw hole 23 is positioned 90 degrees from the alignment of V-Notches 21 and 22. Hole 23 can be a smooth bore for a location pin, but is preferably drilled, threaded and countersunk to be suitable for a flathead screw, to fasten step shaft 7 to knife blade 8.

Minor diameter 24 of step shaft 7 fits into hole 80 in the proximal end of knife blade 8. Minor diameter 24 requires a length sufficient to protrude thru the thickness of knife blade 8. Minor diameter 24 has bottom saw cut 25, on which coil kick spring 9 will act, to impart rotational bias to shaft 7 and thereby, blade 8.

FIGS. 3*a* and 3*b* depict other parts of the assembly, and also demonstrate the simplicity of the design, and that the manner of assembly is a mechanical puzzle. Because of the way the parts fit together, only two fasteners, such as screws, are required.

FIG. 3*a* shows the first steps of the assembly of knife 200. First, the proximal end of blade 8 is placed into the distal end of cavity 11 of frame 2. Next, step shaft 7 is inserted thru pivot hole 14 and through hole 80 in the proximal end of blade 8. The puzzle part fit prevents blade 8 from falling away from frame 2, and allows blade 8 to swing back into cavity 11 into a closed condition and out, into an open condition, typical of a folding pocket knife. Then step shaft 7 is rotated so that hole 23 aligns with a screw hole 100 of blade 8. Fastener screw 10 is then screwed into hole 100, thus aligning V-Notches 21 and 22 at the correct index point.

Continuing with groove 12 facing up, sear 4 and spring 5 are combined and placed into handle keyseat slot 15. Scale 1 is then inserted into front handle dovetail groove 12, in a sliding, free moving fashion. Scale 1 prevents sear 4 from falling out of keyseat slot 15. No additional fasteners are needed.

FIG. 3*b* shows the further steps of the assembly of knife 200. Accessing through pivot hole 14 and the open portion of keyseat slot 15 in frame 2, from the side of groove 13 (FIG. 3*b*), scale 1 is slid until its fastener hole (not shown) is aligned with hole 18 of sear 4. Fastener screw 6 is inserted through the opening in slot 15, and into the hole inside scale 1 to attach sear 4 to the underside of scale 1. Then the inner end of coil kick spring 9 is pressed onto sawcut 25 of the end of minor diameter 24 of step shaft 7. Finally, rear scale 3 is slid into dovetail groove 13 and releasably or permanently wedged (press fit) into place. Rear scale 3 can also be glued into position or left releasable.

Figure 4:
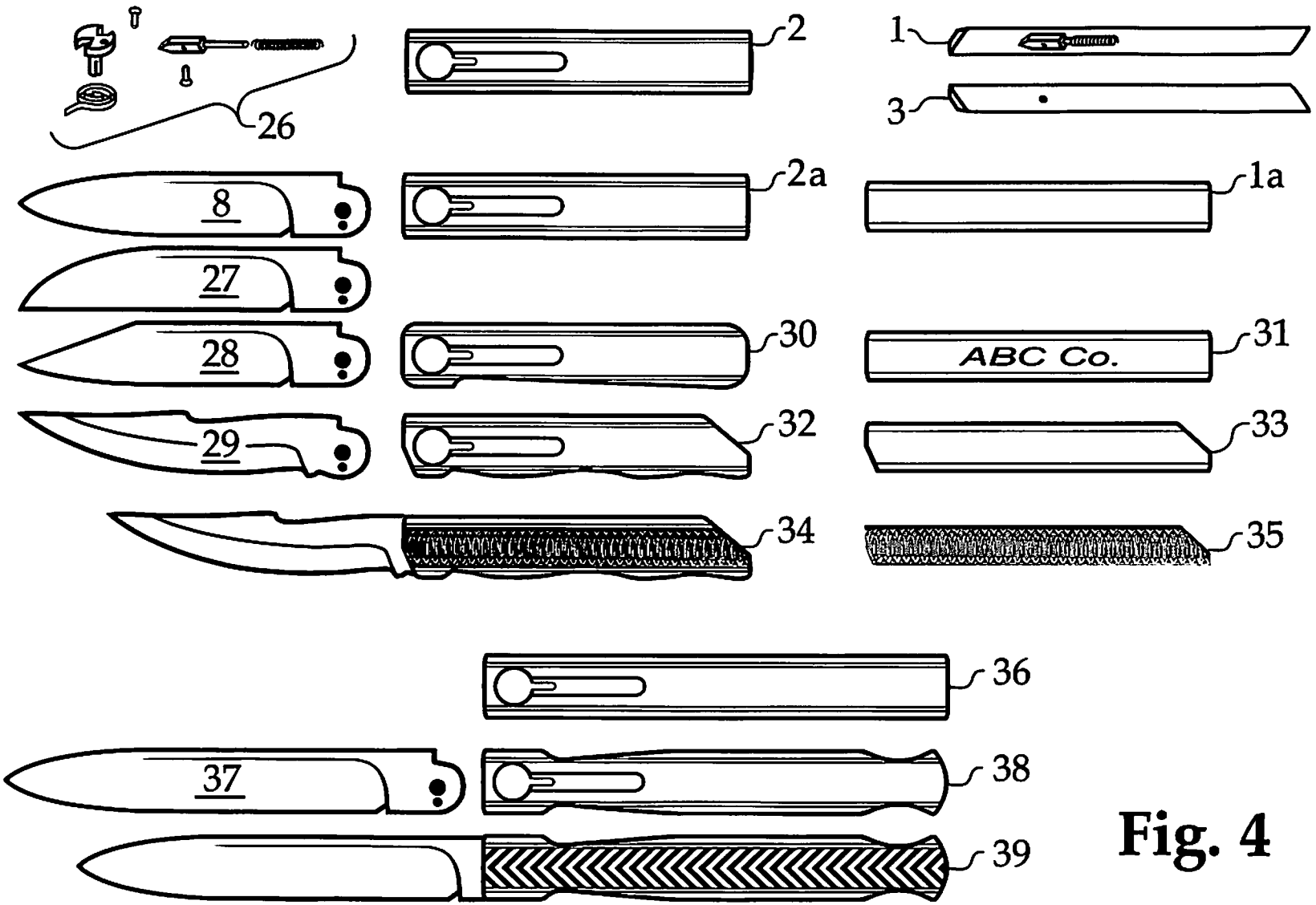
FIG. 4 is a side view of variations on an automatic opening tool with sliding scale release according to different embodiments of the present disclosure.
Figures 5A, 5B, 5C, 5D:
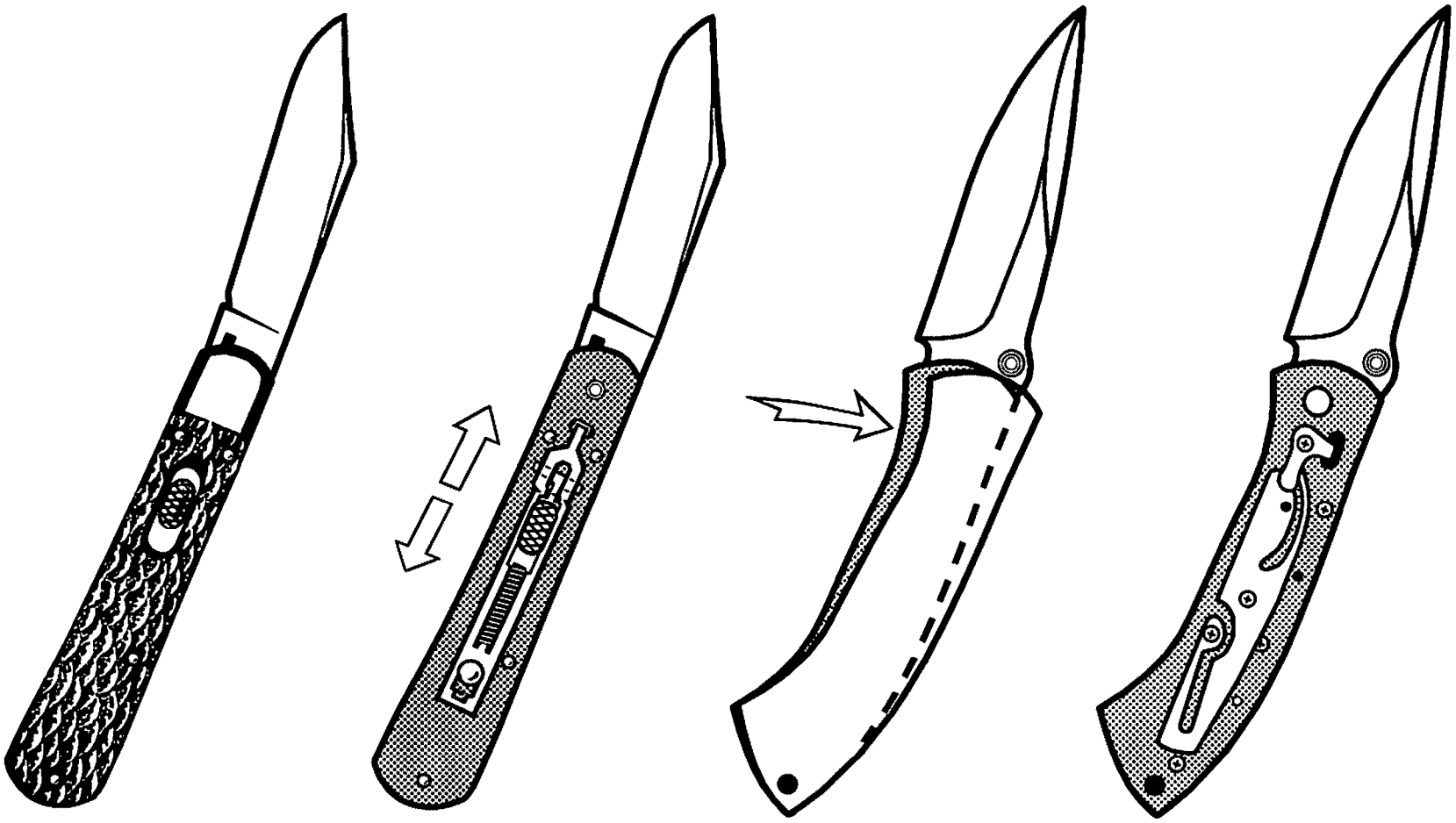
Fig. 5d Prior Art
FIGS. 5*a*-5*d* are side views of prior art knives.

FIG. 4 depicts how the blades and covers of a knife in accordance with the invention can be replaced for enhanced production and marketability to amateur knife-makers. One of the benefits of tool designs in accordance with the invention, is that the internal working parts can be standardized and operate with a variety of alternative exterior tool variations. For example, the knife body itself can exhibit changes in the outward appearance, without affecting the standard sear, step shaft, springs and screws, which can be stockpiled.

It should be understood that although the present disclosure is described as relating to knife blades, that blade element can be replaced by other tools. For example, the knife blade can be replaced by a saw, a ruler, a file, a screwdriver, a fish scaler, a comb, a cork screw, a bottle opener, a can opener, an ice pick, etc. Other replacement blades are contemplated.

Furthermore, the ease of disassembly and reassembly can make for kits that include a basic handle component with multiple blades and other tool components. Referring to FIG. 4, reference numeral 26 refers to that group of parts (blade pivot shaft, resilient member for the shaft, sear, resilient member for the sear, and two connectors), which are all the internal parts. The automatically opening mechanisms for tools in accordance with the invention can consist essentially of these parts and any other parts can be excluded. These parts can be identical throughout any knife variant. Likewise, a stockpile of handle scales 1 and 3 can be made. The scales should have the male dovetail edges, are square cut, and can run oversize, to be trimmed later.

Scale 1 shows as a reference, the chisel point sear fastened to the underside, which converts a normal coverplate scale, into a sliding release button. The basic handle frame 2, can have a rectangular profile. Frame 2 has a large thru bore on one side, which also has a machined key seat stepped slot. Female dovetail tracks run between distal and proximal ends along the length axis. All of this machining enhances the mechanical puzzle effect of the assembly. All of this machining can be confined to the center or one end of the tool body, allowing subsequent modification to the periphery of the handle at a later time. It can be made oversize, to be trimmed later. Other shapes are contemplated.

The second row of parts depicted in FIG. 4, blade 8, a handle body 2*a*, a scale or cover plate 1*a*, can be construed as a basic utility knife, with a minimum of machining to be functional.

Another benefit of a design in accordance with the invention is the user serviceability of the assembly. Rather than a factory fixed assembly, a variety of blades (27, 28 and 29) can be swapped out by a user with relatively low mechanical skill. Even more Swiss army style saws, files and other devices can be produced, including a disposable razor blade holder, requiring only the two-hole pattern in the base of the folding blade. The existing stockpiles of internal parts simply "plug-and-play" with these options.

Another benefit of this design is ease of modification of the handle shape. A handle body 30 that has its profile milled for a tapered hand grip, or another variant profile 32 can be attached. Within specific limits, the handle body can be altered after the fact by a kit buyer to craft his own custom designs.

In another embodiment of the invention, a scale 31 or coverplate is a potential billboard for engraving or printing is available. Buyers can purchase replacements with various semi-precious inlaid materials, or pre-printed sports logos and so forth.

A scale 33, modified to fit a custom profile, the ends can be changed, but the long sides should remain the dovetail shape to fit the sliding track in the handle body. An assembled fancy profile knife 34, with no visible fasteners can be assembled. A sliding button scale coverplate 35, which has a surface texture grip pattern milled into its top surface can also be provided.

Another benefit of this design is a concern for factory manufacturing. The same setup for a short knife can be used for a longer knife. All of the machining for the release components are on one end of the handle body. Unlike other knives that require custom back spine springs tailored to a specific length, this design permits use of the same basic group 26 for any length knife.

A standard rectangular profile handle body 36, similar to body 2, except longer, a longer blade 37, a custom contour profile 38, an assembly of a long stiletto design 39 with a traction grip pattern sliding scale release button, can all be provided.

Not shown is yet another version possible for collectors, a folding boar knife/trench knife, a folding knife with a long blade that is fitted to a short handle body. When closed, the blade end protrudes like a short sheath knife, only to spring open (by a hidden release sliding scale button) into a full length fighting knife.

The wedge shape of chisel point 19 of sear 4, by nature of its wedging action to lock (open or closed) blade 8, can produce a product that is more solid and robust in both the open and closed positions than previously marketed folding boar knives. All of this is possible by the mix and match/plug and play components, that can be marketed separately or in multi-part kit form.

The scale can be removable and interchangeable to swap out advertising company logos engraved or printed as a billboard, or to swap different grip materials. Matched sets of both a folding design of the disclosure and an out-the-front (OTF) knife with similar outward appearance is possible. Although the OTF knife might not include the technology of the disclosure, the design of this modified scale release may have a trademark shape or logo quality that lends itself to production of matching sets with existing conventional internal mechanisms.

The components of the automatic opening tool with sliding scale release described herein can also be provided as a kit to an end user. The tool can be provided to a user disassembled and the user can assemble the components as desired.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

Where this application has listed the steps of a method or procedure in a specific order, it may be possible, or even expedient in certain circumstances, to change the order in which some steps are performed, and it is intended that the particular steps of the method or procedure claim set forth herein below not be construed as being order-specific unless such order specificity is expressly stated in the claim.

While the preferred embodiments of the devices and methods have been described in reference to the environment in which they were developed, they are merely illustrative of the principles of the inventions. Modification or combinations of the above-described assemblies, other embodiments, configurations, and methods for carrying out the invention, and variations of aspects of the invention that are obvious to those of skill in the art are intended to be within the scope of the claims

What is claimed is:

1. An automatically opening tool, comprising:

a frame having first and second side portions with a cavity therebetween and a hole with a first diameter through the first side portion;

a rotatable shaft on the frame, the shaft having a camming surface and a pair of V-shaped notches on opposite sides of the camming surface;

a tool operatively coupled to the shaft and pivotable into and out of the cavity;

a bias member resiliently biasing the shaft into rotation;

a sear having a V-shaped tip matching the V-shaped notches;

a resilient member urging the sear into camming engagement with the shaft; and a frame cover reciprocally mounted on the first side portion of the frame, the frame cover operatively attached to the sear;

wherein the shaft has a stepped configuration with a major diameter substantially equal to the first diameter and a minor diameter, smaller than the major diameter, the V-shaped notches are in the major diameter of the shaft and the minor diameter of the shaft extends through a proximal end of the tool, to pivotally couple the tool to the frame.

2. The automatically opening tool of claim 1, wherein the tool is a knife blade.

3. The automatically opening tool of claim 1, consisting essentially of the frame, one or two frame covers, the tool, the shaft, the sear, the bias member, the resilient member and connectors.

4. The automatically opening tool of claim 1, wherein the frame, the shaft, the sear, the tool, and the frame cover fit together in a puzzle-fit engagement.

5. The automatically opening tool of claim 4, wherein the puzzle-fit engagement requires no more than two fasteners to secure the frame, the shaft, the sear, the tool, and the frame cover into a functioning automatically opening tool.

6. A method of operating a tool, comprising sliding the frame cover of the tool of claim 1 to disengage the sear tip from one of the V-shaped notches.

7. A method of assembling an automatically opening tool, comprising the steps of:

providing a frame having two parallel walls with a cavity therebetween and a shaft opening of a first diameter in at least one of the walls at the distal end of the frame;

placing the proximal end of a blade, having a pivot hole in its proximal end, in the cavity and aligning the pivot hole with the shaft opening;

inserting a shaft having a stepped configuration with a major diameter substantially equal to the first diameter and a minor diameter smaller than the first diameter, the major diameter having a pair of V-shaped notches on opposite sides thereof through the shaft opening and the pivot hole;

attaching the tool to the shaft, such that the tool and the shaft rotate together about the shaft opening;

engaging the tip of a sear into one of the notches, such that the tip of the tool is in the distal location;

covering the sear with a scale and attaching the scale to the sear, such that sliding the scale in the proximal direction, away from the shaft, disengages the tip of the sear from the V-shaped notch; and attaching a resilient member to the shaft, to bias the shaft into rotation, to assemble the tool of claim 1.

8. The method of claim 7, wherein the frame is substantially a mirror image along its longitudinal axis and comprising the step of reassembling the tool as a mirror image, with the scale and the sear on the opposite side of the frame.

9. The method of claim 7, wherein the tool is a knife blade and the frame, the shaft, the sear, the tool, and the frame cove are fit together in a puzzle-fit engagement with only two fasteners.

10. The method of claim 7, comprising replacing the cover or the knife blade with a different cover or knife blade.

11. An automatically swinging tool, comprising:

a frame having a first side wall parallel to a second side wall, with a cavity therebetween having a distal end and a top side, the frame having a top side and a bottom side opposite the top side and a distal end opposite a proximal end, the cavity open at least partially at the distal end and the top side of the cavity;

an opening having a first diameter in the distal end of the first side wall;

a rotatable shaft disposed in the opening and having a stepped configuration with a major diameter substantially equal to the first diameter and a minor diameter, smaller than the major diameter, the shaft having a camming surface and two V-shaped notches on opposite sides of the camming surface in the major diameter portion of the shaft;

a bias member resiliently biasing the shaft into rotation;

a sear coupled to a resilient member at a surface of the first side wall, the resilient member urging the sear in the distal direction, into camming engagement with the camming surface of the shaft, the sear having a V-shaped tip, sized and shaped to fit the V-shaped notches in the shaft, wherein the shaft cannot rotate if the V-shaped tip is engaged in one of the V-shaped notches;

a first cover in reciprocating proximal-distal engagement with the first side wall and coupled to the sear, the first cover, the sear and the resilient member adapted and arranged such that moving the first cover in the proximal direction moves the sear, against the force of the resilient member, in the proximal direction and can free the V-shaped tip from the V-shaped notch, and releasing the first cover permits the resilient member to re-engage the sear against the shaft;

a tool having a proximal end pivotally coupled to the distal end of the frame, and the minor diameter portion of the shaft extends through the proximal end of the tool, and pivotally couples the tool to the frame, the tool and shaft adapted and arranged such that rotating the shaft rotates the tool.

12. The automatically swinging tool of claim 11, comprising a resilient kick member coupled to the shaft to urge the shaft to rotate and thereby pivot the tool.

13. The automatically swinging tool of claim 12, comprising a mechanism for automatically moving the tool from a closed to an open position consisting essentially of the shaft coupled to the tool and a resilient kick member, and the sear coupled to the resilient member and the first cover.

14. The automatically swinging tool of claim 11, wherein the tool is a knife blade.

15. The automatically swinging tool of claim 11, wherein the tool is a screw driver, comb, corkscrew or file.

16. The automatically swinging tool of claim 11, comprising a coil spring attached to the shaft and adapted to urge the shaft to rotate and thereby pivot the tool.

17. The automatically swinging tool of claim 11, wherein the opening is a thru hole through the first and second walls of the frame, which are substantially mirror images of each other.

18. The automatically swinging tool of claim 17, wherein the sear is on the outside of the first wall of the frame, between the frame and the first cover, and the frame and sear are adapted to also be reconfigured into a second arrangement, with the sear on the outside of the second wall, in camming engagement with the shaft and the cover in reciprocating proximal-distal engagement with the second wall, over the sear, with the sear coupled to the inside of the first cover over the second wall, wherein moving the cover in the proximal direction disengages the sear from the shaft.

19. The automatically swinging tool of claim 18, wherein the tool is a knife and the coil spring is adapted to cause the knife to pivot out from the cavity when the cover is slid to disengage the sear from one of the V-shaped notches on the shaft and the sear re-engages in the other notch in the shaft to lock the knife in an open position.

* * * * *